US006551000B2

(12) United States Patent
Kandasamy et al.

(10) Patent No.: US 6,551,000 B2
(45) Date of Patent: Apr. 22, 2003

(54) COMPOSITION AND CONTAINER FOR TREATING A VERTICAL SURFACE

(75) Inventors: Manivannan Kandasamy, Hyogo (JP); Aya Nakao, Osaka (JP); Masaki Wakabayashi, Hyogo (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/242,644

(22) Filed: Sep. 12, 2002

(65) Prior Publication Data

US 2003/0059247 A1 Mar. 27, 2003

Related U.S. Application Data

(60) Provisional application No. 60/322,142, filed on Sep. 14, 2001.

(51) Int. Cl.[7] ..... B43M 11/06

(52) U.S. Cl. ..... 401/183; 206/229; 206/572; 401/186; 401/195; 401/196; 401/205; 401/263; 401/265; 401/270

(58) Field of Search ..... 401/183–186, 401/195, 196, 205, 263, 265, 270; 206/572, 229

(56) References Cited

U.S. PATENT DOCUMENTS

| | | | | | |
|---|---|---|---|---|---|
| 4,958,596 | A | * | 9/1990 | Belan | 401/183 X |
| 5,971,645 | A | | 10/1999 | Fukushima et al. | |
| 6,086,278 | A | * | 7/2000 | Keller | 401/183 |
| 6,155,413 | A | * | 12/2000 | Bilanchone | 206/229 |
| 6,315,478 | B1 | * | 11/2001 | Atkins | 401/183 X |

FOREIGN PATENT DOCUMENTS

| | | |
|---|---|---|
| WO | WO 97/13729 | 4/1997 |
| WO | WO 97/13730 | 4/1997 |

* cited by examiner

*Primary Examiner*—Gregory L. Huson
*Assistant Examiner*—Kathleen J. Prunner
(74) *Attorney, Agent, or Firm*—Julia A. Glazer; Kim William Zerby; Steven W. Miller

(57) ABSTRACT

An improved container contains a housing containing at least one aperture and a treatment composition located within the housing. The combination of the treatment composition and the housing has a mess factor of from about $3.6*10^{-4}$ to about $1.1*10^{-11}$. When the housing is in a prepared state and squeezed, the treatment composition exits the housing from the aperture.

11 Claims, 1 Drawing Sheet

COMPOSITION AND CONTAINER FOR TREATING A VERTICAL SURFACE

CROSS REFERENCE TO RELATED APPLICATIONS

This application claims priority under 35 U.S.C. §119(e) to U.S. application Ser. No. 60/322,142, filed Sep. 14, 2001.

FIELD OF THE INVENTION

The present invention relates to a composition and container for treating a vertical surface. Specifically, the present invention relates to a container which contains a composition, which is a treatment composition.

BACKGROUND OF THE INVENTION

Vertical surfaces, such as walls, curtains, and may be cleaned and/or treated by many methods, such as washing, scrubbing, vacuuming, etc. However, many methods and apparatuses for cleaning a vertical surface tend to be messy, inconvenient, and/or burdensome. Specifically, when applied to a vertical surface, many compositions tend to run down the vertical surface and collect and/or drip to make the area below the vertical surface messy. In cases where the vertical surface is part of something which is held in the hand, for example, a shoe, then the dripping may make the user's hand messy and may thus necessitate additional rinsing or washing steps.

While containers for holding, storing and applying a product are well-known, and while treatment compositions such as cleaning compositions, bleaching compositions, conditioning compositions, etc. are also well known, the treatment of vertical surfaces remains a messy and awkward process.

SUMMARY OF THE INVENTION

The present invention relates to an improved container which contains a housing containing at least one aperture and a treatment composition located within the housing. The combination of the treatment composition and the housing has a mess factor of from about $3.6*10^{-4}$ to about $1.1*10^{-11}$. When the housing is in a prepared state and squeezed, the treatment composition exits the housing from the aperture.

The present invention also relates to a kit containing such an improved container and a set of instructions which contain a recommendation to treat an item by applying the treatment composition to a surface. At least a part of the surface is vertically oriented during the application step.

It has now been found that the combination of a container and a treatment composition having the mess factor described may significantly reduce messiness when the treatment composition is applied to a vertical surface. Moreover, the significant advantages of the present invention are especially noticeable when the vertical surface is part of an item which is held in the hand, such as a shoe or a laundry item, and more especially a shoe.

These and other features, aspects, advantages, and variations of the present invention, and the embodiments described herein, will become evident to those skilled in the art from a reading of the present disclosure and accompanying figures with the appended claims, and are covered within the scope of these claims.

BRIEF DESCRIPTION OF THE FIGURES

While the specification concludes with claims particularly pointing out and distinctly claiming the invention, it is believed that the invention will be better understood from the following description of the accompanying figures in which like reference numerals identify like elements, and wherein:

DETAILED DESCRIPTION OF THE INVENTION

All percentages, ratios and proportions herein are by weight of the final treatment composition, unless otherwise specified. All temperatures are in degrees Celsius (°C.) unless otherwise specified. All documents cited are incorporated herein by reference in their entireties. Citation of any reference is not an admission regarding any determination as to its availability as prior art to the claimed invention.

As used herein, the term "alkyl" means a hydrocarbyl moiety which is straight or branched, saturated or unsaturated. Unless otherwise specified, alkyl moieties are preferably saturated or unsaturated with double bonds, preferably with one or two double bonds. Included in the term "alkyl" is the alkyl portion of acyl groups.

As used herein, the term "comprising" means that other steps, ingredients, elements, etc. which do not affect the end result can be added. This term encompasses the terms "consisting of" and "consisting essentially of".

The term "cP" as used herein refers to a centipoise unit. Centipoise is the cgs-metric system unit of viscosity and has the dimensions of dyne-seconds per square centimeter, or grams per centimeter-second. Viscosity as described herein is measured gat 25° C., and at a shear rate of 1 $sec^{-1}$.

Container

Figure 1:
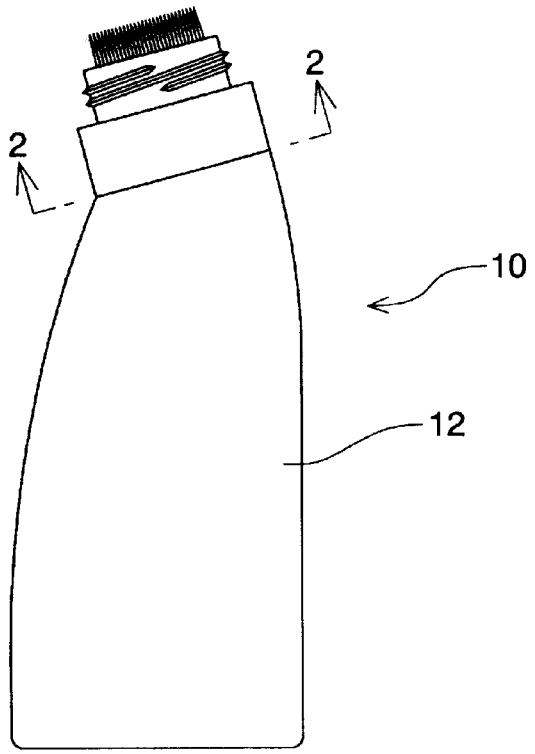
FIG. 1 is a side view of a preferred embodiment of a container.

Referring to the Figures, FIG. 1 shows a side view of a preferred embodiment of a container, 10. The container, 10, useful herein and methods for forming the container are known per se in the art of container making. The container, 10, is a pre-treatment container which has a housing, 12, such as a hollow body member, which contains at least one aperture (See FIG. 2 at 20) from which the treatment composition may pass. The container typically is shaped and sized to be held in the hand, and therefore typically holds from about 50 mL to about 1 L of liquid, preferably from about 100 mL to about 750 mL, and more preferably from about 1500 mL to about 500 mL therein when in a prepared state.

The housing may be formed as integral to the container, or may be formed as a separate portion and then added, combined, and/or connected to another piece to form the container. The container and/or housing is preferably made of materials which are inert with respect to the treatment composition. Preferred container and/or housing materials include those selected from plastic, rubber and a combination thereof, and more preferably the container and/or housing material is selected from polyethylene, polypropylene, polyethylene terephthalate and a combination thereof. Such materials are preferred as they are easy and cheap to form, while also being relatively inert to most treatment compositions. Preferably, the container and/or the housing is designed so as to be compressible when pressure is applied by a user's hand. This allows a user to squeeze the housing and thereby easily control the amount of treatment composition applied and the rate at which it is applied.

Figure 2:
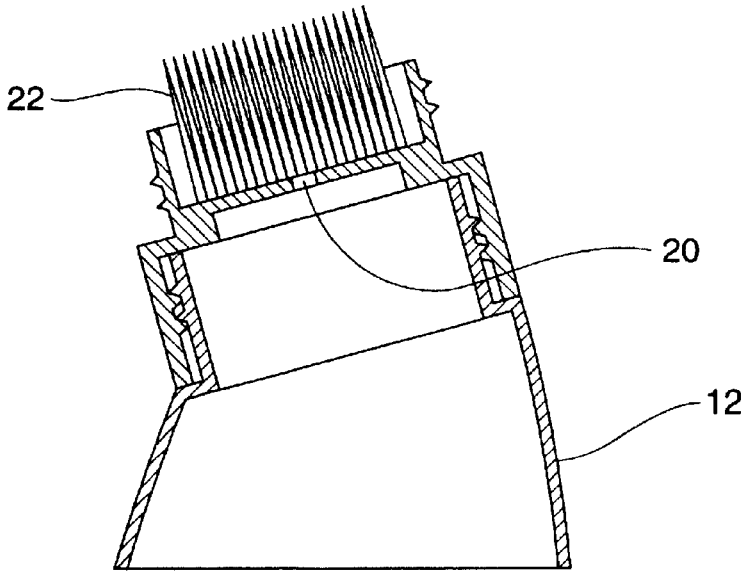
FIG. 2 is a partial cut-away view of the container of FIG. 1.

FIG. 2 is a partial cut-away side view of the container of FIG. 1, as seen along line 2—2. In FIG. 2, it can be seen that the housing, 12, contains at least one aperture, 20, through which the treatment composition exits the housing, 12, so as to contact the surface to be treated. The aperture typically has a diameter of from about 0.8 mm to about 4 mm, and preferably from about 0.8 mm to about 2 mm. Multiple apertures may be present, and may be preferred in instances where the surface to be treated is a large surface, or where a relatively large amount of treatment is to be dispensed at a time.

In addition, as seen in FIG. 2, the housing, 12, may further contain an applicator, 22, in connected relation to the aperture, 20, preferably in direct contact with and/or surrounding the aperture, 20, such that when the treatment composition contacts the applicator, 22, soon or immediately after exiting the aperture, 20. Typical applicators useful herein include a brush, a rollerball, a scrubbing mesh, a sponge, a groove, a ridge, a rubbing nub and a combination thereof, preferably a brush, a scrubbing mesh, a sponge, a rubbing nub and a combination thereof, and more preferably a brush, a scrubbing mesh and a combination thereof. The applicator may be formed as an integral part of the housing and/or the aperture, or may be made separately made and attached thereto, as seen in FIG. 2.

The container preferably contains additional components which are typically found in a container and/or a pre-treatment container, such as a cap, a handle, a flip-top, a screw-top, a leak-resistant valve, a dosing device, etc., and may be either disposable or refillable, as desired. The container may require a particular orientation and/or action to place it within a prepared state which is "ready-to-use". For example, the cap may need to be removed, and the container inverted and placed with the applicator touching the surface to be treated, so as to be in a prepared state. Alternatively, the container may always be in a prepared state and ready-to-use.

Containers, housings, apertures, and/or applicators useful herein are described, in for example, PCT Patent Publication No. WO 98/16438 A1 to Fukushima, et al., published on Apr. 23, 1998; PCT Patent Publication No. WO 99/37849 A1 to Deflander, et al., published on Jul. 29, 1999; U.S. Pat. No. 5,971,645 to Fukushima, et al., issued on Oct. 26, 1999; PCT Patent Publication No. WO 01/21499 A1 to Silud and Ng, published on Mar. 29, 2001; and PCT Patent Publication No. WO 00/20676 A1 to Taneko and Fukushima, published on Apr. 13, 2000. Other containers known in the art may also be useful herein.

Treatment Composition

The treatment composition useful herein is typically a cleaning composition, a conditioning composition, or a mixture thereof, but is preferably either a cleaning composition or a conditioning composition. The treatment composition herein has a mess factor of from about $3.6*10^{-4}$ to about $1.1*10^{-11}$, preferably from about $3.6*10^{-4}$ to about $1*10^{-9}$, and more preferably from about $3.6*10^{-4}$ to about $5*10^{-8}$. The mess factor herein is calculated as a function of the viscosity of the treatment composition, the squeezability of the housing, the absorbency of the surface to which the treatment composition is applied, and the drip factor of the composition. Specifically, the mess factor is calculated according to the following formula:

Mess Factor=(Viscosity)(Squeezability)(1/Absorbency)(Drip Factor), where the viscosity, squeezability, absorbency, and drip factor are measured as described in the Test Methods, below.

The treatment composition useful herein typically contains an ingredient selected from a surfactant, a builder, a viscosity modifier, a hydrotrope, a solvent, a conditioning agent, a polymer and a mixture thereof, preferably a surfactant, a solvent, a conditioning agent and a mixture thereof. Other cleaning composition and conditioning composition ingredients known in the art, and especially ingredients known in the art of shoe cleaning and shoe conditioning may also be useful in the treatment composition herein.

Preferred treatment compositions useful herein include those described in U.S. Provisional Patent Application No. 60/161118 to Na, et al., filed on Oct. 22, 1999; PCT Patent Publication No. WO 01/30955 A1 to Siklosi, et al., published on May 3, 2001.

The present container and treatment composition may further be employed in conjunction with additional components, such as a washing machine, a washing bag, a washing process, etc. Such additional components and methods are described in, for example, PCT Patent Publication No. WO 01/31109 to Hortel, et al., published on May 3, 2001; and U.S. patent application Ser. No. 09/666113 to Rogers and Perry, filed on Sep. 20, 2000.

Test Methods

The viscosity of the treatment composition useful herein is directly measured with a Physica Rheolab MC 100 rheometer, at a temperature of 25 □C and using a Z2 DIN (45 mm) measuring system. The software is Paar Physica US200 software. The viscosity of the treatment composition useful herein is typically from about 150 cP (i.e., 0.150 N-sec/$m^2$) to about 40,000 cP (i.e., 40 N-sec/$m^2$), preferably from about 2,000 cP (i.e., 2 N-sec/$m^2$) to about 33,000 cP (i.e., 32 N-sec/$m^2$), and more preferably from about 3,000 cP (i.e., 3 N-sec/$m^2$) to about 32,000 cP (i.e., 32 N-sec/$m^2$).

Squeezability is a measurement of the interaction between the rheology of the treatment composition, the housing construction design, the housing materials, the sheer characteristics of the treatment composition, the aperture size. In order for the squeezability test to better approximate the actual usage conditions of a container and treatment composition, the average amount of force applied by a user to a standard container when squeezing for a period of one second was measured and determined to be 57.6 Newtons of force. Thus, the squeezability of the housing useful herein is measured by a squeezability tester which measures the amount of product dosed when the housing is placed in a prepared state and a lateral force of 57.6 Newtons is applied to the side of the housing for 1 second. The amount of product dosed, and the distance traveled by the lateral force during this time are measured. Thus, the squeezability as measured and calculated herein has the units of (g of product dosed*distance traveled in mm/57.6 N force). The squeezability was measured for a variety of containers and treatment compositions. Accordingly, the typical squeezability useful herein is from about $2.8*10^{-3}$ g*mm/N to about 1.4 g*mm/N, preferably $1*10^{-3}$ g*mm/N to about 1.4 g*mm/N, more preferably about $1.4*10^{-2}$ g*mm/N to about 1.4 g*mm/N. This test is conducted at 25° C.

The absorbency test herein measures the amount of water absorbed by a surface, per $m^2$ of the surface. Specifically, a 15 cm×15 cm square of the surface to be tested (i.e., a test surface) is dried and weighed to determine it's dry weight. The balance used to measure the sample is preferably a Mettler PM 4600 DeltaRange (B-082) scientific balance, available from Mettler Co. 750 mL water (25° C.) is placed in a 20 cm×27 cm×8.5 cm plastic tray. The test surface is then gently placed on the water in the tray and left for 15 seconds. It has been found that when treating a vertical surface, or an item having a vertical surface, such as a shoe, the typical consumer spends about 3 minutes to cover the item. Accordingly, the test surface is then removed from the tray and vertically hung for 3 minutes to removed unabsorbed water. After 3 minutes, the "wet sample" is then weighed to get the wet weight. The amount of water absorbed is calculated by subtracting the dry weight from the wet weight. The absorbency is then calculated as: (g water absorbed/fabric area in $m^2$). It has been found that the absorbency of a surface is dependent upon both the material it is formed from as well as the characteristics of the surface, such as it's roughness and porosity. In fact, it has been found that even though they are made of hydrophobic substances such as nylon, polyester, etc., which are typically considered "nonabsorbent", fabrics and meshes formed from these substances may yet absorb considerable amounts of water according to this test. The absorbency of the surfaces useful herein typically ranges from about 6 $g/m^2$ for shiny leathers and plastics to about 650 $g/m^2$ for porous, mesh surfaces. Without intending to be limited by theory, it is believe that surfaces having the above absorbency are especially well treated by the treatment compositions herein, and the container.

The drip factor is calculated form a dripping test which measures the ratio of the amount of treatment composition which drips off of a surface which is held vertically for 3 minutes, vs. the amount of treatment composition which does not drip off of the surface. Specifically, a 3 cm×11 cm test surface is prepared by drawing a line 1 cm from one end to define a 1 cm×3 cm attachment area. The test fabric is then vertically hung from a stand by attaching a clip in the attachment area, so that 10 cm of the test surface hangs vertically below the clip. A container for catching any treatment composition which drips off of the test surface is weighed to find the empty container weight, and then is placed below, but not touching the bottom edge of the test surface. The balance used is the same Mettler PM 4600 DeltaRange balance as described above. 3 g of treatment composition is placed at the line, and the test surface is left undisturbed for 3 minutes. After 3 minutes, the container, which has caught any of the treatment product which has dripped off of the test surface, is removed and weighed. The drip factor is then calculated as: {(grams of product dripped into the container)/(180 seconds*100 mm)}/(3 grams of treatment product dosed).

Method of Use

The container and treatment composition herein are typically sold together in a kit, along with instructions for use which include a recommendation to apply the treatment composition to a surface, such as a shoe. At least a part of the surface is vertically oriented during the applying step, but need not be vertically oriented during the entire applying step. For example, when applying the treatment composition to a shoe, the user may rotate the shoe as they are applying the treatment composition thereto. However, the present invention significantly reduces messiness when the composition is applied to the surface, and especially when the surface is vertically oriented.

The housing is then placed in a prepared state, which indicates that when squeezed, the treatment composition will exit the housing via the aperture. Actions to place the housing in a prepared state typically include, for example: removing a cap and/or plug from the container, housing, and/or aperture; inverting the housing so as to touch the aperture and/or the applicator to the top of a surface; diluting the treatment composition; filling the container and/or housing with the treatment composition; and/or attaching an applicator to the aperture.

The aperture and/or applicator is then typically placed close to, or even touching the surface to be treated, and the housing squeezed by hand for a period of time, so as to apply the treatment composition to the surface. The housing will typically be squeezed for a period of time ranging from about 0.25 seconds to about 1 minute, more preferably from about 0.5 seconds to about 30 seconds, and even more preferably from about 0.75 seconds to about 15 seconds. Longer periods of squeezing are especially tiring to a user's hand, and are therefore not desirable, whereas short periods of squeezing typically do not provide a user with sufficient control over the amount of treatment composition applied to the surface.

A single squeeze typically forces at least 0.1 g, preferably from about 0.1 g to about 10 g, and more preferably from about 0.2 to about 7 g of the treatment composition from the aperture.

If an applicator, such as a preferred brush is present, then the user may optionally scrub the surface with the applicator, and/or otherwise employ the applicator to ensure that the treatment composition has coated, been absorbed into, and/or has properly contacted the area(s) to be treated. An applicator, such as a soft or hard brush is especially preferred where the surface to be treated is a shoe surface which is to be cleaned. Without intending to be limited by theory, it is believed that a brush may be especially beneficial to apply a cleaning composition into to a shoe surface, while simultaneously helping to dislodge dirt and oils. Such a multiple-cleaning action saves time and effort for the user, while reducing messiness.

The surface to which the treatment composition is applied may be any one of many surfaces to be treated, such as, cotton, leather, nylon, polyethylene, polyester, polypropylene, plastic, rubber and a combination thereof, preferably cotton, leather, nylon, rubber and a combination thereof, as these are commonly used in shoe surfaces such as dress shoes and sport/exercise shoes. Furthermore, the present invention may be used to treat a surface which may have one or more characteristics, such as being flat, rough, formed of a mesh, a woven or nonwoven fabric, natural, processed, colored, dyed, etc.

Examples of the invention are set forth hereinafter by way of illustration and are not intended to be in any way limiting of the invention. The examples are not to be construed as limitations of the present invention since many variations thereof are possible without departing from its spirit and scope.

EXAMPLE 1

A relatively high viscosity cleaning composition A (9528 cP) was placed in a 220 mL container according to FIG. 1, having a single aperture size of 1.3 mm in diameter, and was inverted for a period of 3 seconds, to allow the treatment composition to settle near the aperture. The cleaning composition and container have a mess factor of $1.09*10^{-5}$. The plastic cap is removed and the brush is placed so as to contact the top of an exercise shoe formed of synthetic leather and rubber soles. The housing is squeezed to dose about 3 g of product onto the brush which is then rubbed along the surface of the shoe. All areas of the shoe are contacted by the brush, with repeated squeezing of the housing to dose more cleaning composition, to dose 15 g of cleaning composition, total. Very little messiness is encountered, and no product drips from any part of the shoe surface.

Comparative Example A

A high viscosity (3300 cP) cleaning composition C was placed in a container similar to that of FIG. 1, except that it has an orifice of 1.0 mm, and that the squeezability of the housing is $2.77*10^{-3}$ g-mm/N and the mess factor is $7.6*10^{-9}$. This container is too hard to squeeze, and therefore is difficult to use to clean a shoe which is similar to that of Example 1. Specifically, only 0.04 g of product is dosed per squeeze compared to 0.5 g of product dosed per squeeze in Example 1.

EXAMPLE 2

A container and compositions according to Example 1 is prepared, where the cleaning composition has the formula:

| | Composition A | Composition B | Composition C |
|---|---|---|---|
| Alkyl ethoxy sulfate | 18% | — | — |
| Linear alkyl sulfonate | 6% | 15% | — |
| Other surfactants | 4.2% | 9.8% | 10% |
| Builders | 11% | 11% | 75.73% |
| Enzymes | 1.25% | 1.23% | — |
| Water & additional ingredients | Balance | Balance | Balance |
| Viscosity at shear rate (1/sec) | 9528 | 155 | 3300 |
| Mess Factor when placed in the container of Example 1 | $1.09 * 10^{-5}$ | $3.3 * 10^{-9}$ | $7.6 * 10^{-9}$ |

While compositions B and C may be used in the present invention, Composition A provides significantly easier application and less messiness.

What is claimed is:

1. A container comprising:

A. a housing comprising at least one aperture; and

B. a treatment composition located within the housing, wherein the combination of the treatment composition and the housing has a mess factor of from about $3.6*10^{-4}$ to about $1.1*10^{-11}$, wherein when the housing is in a prepared state and squeezed, the treatment composition exits the housing from the aperture.

2. The container of claim 1, wherein the housing further comprises an applicator in connected relation to the aperture, and wherein when the treatment composition exits the housing from the aperture the treatment composition contacts the applicator.

3. The container of claim 1, wherein the aperture has a diameter of from about 0.8 mm to about 4 mm.

4. The container of claim 1, wherein the composition has a viscosity of from about 2,000 cP to about 33,000 cP when measured at 25° C. and at a shear rate of 1 $sec^{-1}$.

5. The container of claim 1, wherein the housing is formed of a material selected from the group consisting of polyethylene, polypropylene, polyethylene terephthalate and a combination thereof.

6. The container of claim 1, wherein the treatment composition has a mess factor of from about $3.6*10^{-4}$ to about $1*10^{-9}$.

7. The container of claim 1, wherein the treatment composition is a cleaning composition.

8. The container of claim 1, wherein the treatment composition is a conditioning composition.

9. A kit comprising a container according to claim 1, and a set of instructions comprising a recommendation comprising the step of applying the treatment composition to a surface, wherein a least a part of the surface is vertically oriented during the applying step.

10. A kit according to claim 9, wherein the surface is selected from the group consisting of cotton, leather, nylon, polyethylene, polyester, polypropylene, plastic, rubber and a combination thereof.

11. A kit according to claim 9, wherein the surface comprises a shoe surface.

* * * * *